US006666153B2

(12) United States Patent
Dickinson et al.

(10) Patent No.: US 6,666,153 B2
(45) **Date of Patent: *Dec. 23, 2003**

(54) ADJUSTABLE SHELF ANCHOR

(75) Inventors: Thomas Dickinson, St. Louis, MO (US); Scott Holmberg, Ballwin, MO (US)

(73) Assignee: Continental Commercial Products, LLC, St. Louis, MO (US)

( * ) Notice: Subject to any disclaimer, the term of this patent is extended or adjusted under 35 U.S.C. 154(b) by 33 days.

This patent is subject to a terminal disclaimer.

(21) Appl. No.: 09/872,114

(22) Filed: Jun. 1, 2001

(65) Prior Publication Data

US 2002/0029727 A1 Mar. 14, 2002

Related U.S. Application Data

(63) Continuation-in-part of application No. 09/624,783, filed on Jul. 25, 2000, now Pat. No. 6,460,469.

(51) Int. Cl.[7] ..... A47B 5/00
(52) U.S. Cl. ..... 108/152; 108/108; 248/250
(58) Field of Search ..... 108/152, 108; 248/235, 250; 211/90.01, 90.04, 187

(56) References Cited

U.S. PATENT DOCUMENTS

| | | | | |
|---|---|---|---|---|
| 883,323 | A | | 3/1908 | Macduff |
| 1,279,416 | A | | 9/1918 | Osborne |
| 1,502,288 | A | | 7/1924 | Boye |
| 2,219,975 | A | | 10/1940 | Bentz |
| 3,631,821 | A | | 1/1972 | Zachariou |
| 3,675,882 | A | | 7/1972 | Dibble |
| 3,704,675 | A | | 12/1972 | Bellasalma |
| 4,183,488 | A | | 1/1980 | Shepard |
| 4,646,998 | A | | 3/1987 | Pate |
| 4,738,426 | A | | 4/1988 | Bessinger |
| 4,783,035 | A | | 11/1988 | Remmers |
| 4,799,643 | A | | 1/1989 | Shepard |
| 4,856,746 | A | * | 8/1989 | Wrobel et al. |
| 4,909,465 | A | * | 3/1990 | Lyman |
| 4,934,642 | A | * | 6/1990 | Baron et al. |
| 5,156,096 | A | | 10/1992 | Lamprey |
| 5,406,894 | A | * | 4/1995 | Hermann et al. |
| 5,527,084 | A | | 6/1996 | Scherf |
| 5,575,444 | A | * | 11/1996 | Otema |
| 5,799,803 | A | | 9/1998 | Muller |

* cited by examiner

*Primary Examiner*—Jose V. Chen
(74) *Attorney, Agent, or Firm*—Pennie & Edmonds LLP

(57) ABSTRACT

A shelving unit comprises a shelf and a shelf anchor for securing the shelf to an adjacent wall. The shelf has a peripheral rim that extends along at least a portion of the length of the shelf. The shelf has at least one internal lateral support member extending generally perpendicularly to the rim. The shelf anchor includes a base and a shelf-retainer. The base is adapted to be mounted to the wall. The shelf-retainer extends from the base. A retaining portion of the shelf-retainer is spaced from a front side of the base to define a rim-receiving recess between the base and the retaining portion of the shelf-retainer. The shelf anchor is positioned relative to the shelf so that at least a portion of the peripheral rim is received within the rim-receiving recess in a manner to prevent the shelf from moving outwardly from the wall when the shelf anchor is mounted to the wall. The shelf-retainer includes a lateral positioner. The shelf anchor is positioned relative to the shelf so that at least a portion of the lateral support member engages with the positioner in a manner to prevent sideways movement of the shelf relative to the wall when the shelf anchor is mounted to the wall.

20 Claims, 5 Drawing Sheets

ADJUSTABLE SHELF ANCHOR

This Application is a continuation-in-part of application Ser. No. 09/624,783 filed Jul. 25, 2000 now U.S. Pat. No. 6,460,469.

BACKGROUND OF THE INVENTION

The present invention pertains to shelving and, more particularly, to shelving units for general household and utility use. A variety of shelf structures and shelving assemblies are known in the art. Many shelving assemblies are provided as "knock down" kits for assembly by the user at a location where the shelving assembly is to be used. This minimizes shipping costs by avoiding the need to transport bulky shelving assemblies. Such knock down shelving assemblies typically include a plurality of generally planar shelves separated by poles connected to the corners of the shelves. The interconnecting components are usually inexpensive and are typically made of a light weight polymeric material, such as molded polypropylene, to further reduce manufacturing and shipping costs.

Most knock down shelving assemblies are intended for use as stand alone units and, in general, they are sufficiently strong and stable for their intended purposes, despite their light weight construction. However, the light weight construction increases the propensity for tipping when improperly loaded. For example, the unbalanced load of a child climbing on one side of the shelving unit may cause the entire unit, and all things stored thereon, to tip over onto the child.

To reduce the likelihood of such dangers, various support brackets have been devised for securing shelves to adjacent walls. In general, such prior art brackets are secured to a wall in a selected location where the shelving unit is to be used. The shelving unit is moved into place and then connected to the pre-mounted bracket. While this is generally effective in preventing tipping of the shelving unit, mounting such brackets in a proper location on the wall before the shelving unit is moved into place can be difficult. Moreover, such brackets are typically designed for connection to particular portions of the shelving unit and are fixed relative thereto once connected. Therefore, although the user may have a particular location in mind for the shelving unit, the precise location may be dictated, at least in part, by the location of wall studs to which to brackets may be mounted.

Thus, there is a need for a shelving unit having mounting brackets or "anchors" that are connectable to the shelving unit prior to being secured to a wall, and which are adjustable relative the shelving unit to permit precise positioning of the anchor relative to the wall.

SUMMARY OF THE INVENTION

It is a general object of the present invention to provide a shelving unit including a shelf anchor configured for securing the shelving unit to an adjacent wall to prevent tipping. A more specific object of the invention is to provide a shelving unit having a mounting anchor that is connectable to the shelving unit prior to being secured to a wall, and which is adjustable along the perimeter of the shelf to permit precise positioning of the anchor relative to the wall to which the shelving unit is to be secured.

In general, a shelving unit of the present invention comprises a shelf and a shelf anchor for securing the shelf to an adjacent wall. The shelf has a peripheral rim that extends along at least a portion of the length of the shelf. The shelf has at least one internal lateral support member extending generally perpendicularly to the rim. The shelf anchor includes a base and a shelf-retainer. The base is adapted to be mounted to the wall. The shelf-retainer extends from the base. A retaining portion of the shelf-retainer is spaced from a front side of the base to define a rim-receiving recess between the base and the retaining portion of the shelf-retainer. The shelf anchor is positioned relative to the shelf so that at least a portion of the peripheral rim is received within the rim-receiving recess in a manner to prevent the shelf from moving outwardly from the wall when the shelf anchor is mounted to the wall. The shelf-retainer includes a lateral positioner. The shelf anchor is positioned relative to the shelf so that at least a portion of the lateral support member engages with the positioner in a manner to prevent sideways movement of the shelf relative to the wall when the shelf anchor is mounted to the wall.

In another aspect of the invention, a shelving unit comprises a shelf and a shelf anchor having a base, a bridge portion and a shelf-retaining portion. The shelf has a generally vertical peripheral rim that extends along at least a portion of the length of the shelf. The shelf also has at least one internal lateral support member extending generally perpendicularly to the rim. The base of the shelf anchor has front and rear sides. The rear side of the base has a wall-engaging portion adapted for flush engagement with the wall. The bridge portion of the base extends outwardly from the front side of the base. The -retaining portion of the base extends generally vertically from a distal end of the bridge portion. The shelf-retaining portion is spaced from the front side of the base to define a rim-receiving recess between the front side of the base and the shelf-retaining portion. The shelf anchor is positioned relative to the shelf so that at least a portion of the peripheral rim is received within the rim-receiving recess in a manner to prevent the shelf from moving outwardly from the wall when the shelf anchor is mounted to the wall. The shelf-retaining portion has a positioning recess. The shelf anchor is positioned relative to the shelf so that at least a portion of the lateral support member is received within the positioning recess in a manner to prevent the shelf from moving sideways relative to the wall when the shelf anchor is mounted to the wall.

In still another aspect of the invention, a shelving unit comprises a shelf and a shelf anchor having a base, a bridge portion, shelf-retaining portion and a lateral engagement surface. The shelf has a generally vertical peripheral rim that extends along at least a portion of the length of the shelf. The base of the shelf anchor has front and rear sides. The rear side of the base has a wall-engaging portion adapted for flush engagement with the wall. The bridge portion of the base extends outwardly from the front side of the base. The shelf-retaining portion of the base extends generally vertically from a distal end of the bridge portion. The shelf-retaining portion is spaced from the front side of the base to define a rim-receiving recess between the front side of the base and the shelf-retaining portion. The shelf anchor is positioned relative to the shelf so that at least a portion of the peripheral rim is received within the rim-receiving recess in a manner to prevent the shelf from moving outwardly from the wall when the shelf anchor is mounted to the wall. The lateral engagement surface engages an opposed lateral surface of the shelf in a manner to prevent the shelf from moving sideways relative to the wall when the shelf anchor is mounted to the wall.

A method for securing a shelving unit to a wall is also disclosed. The method comprises the steps of: providing a shelf anchor having a rim-receiving recess adapted to receive a portion of a peripheral rim of a shelf, and a positioning recess adapted to receive a portion of an internal lateral support member of the shelf; positioning the shelf anchor on the shelf so that a portion of the peripheral rim is received within the rim-receiving recess; positioning the shelf anchor on the shelf so that a portion of the internal lateral support member is received within the positioning recess; and securing the shelf anchor to the wall.

While the principal advantages and features of the present invention have been described above, a more complete and thorough understanding and appreciation for the invention may be attained by referring to the drawings and description of the preferred embodiments, which follow.

Figure 1:
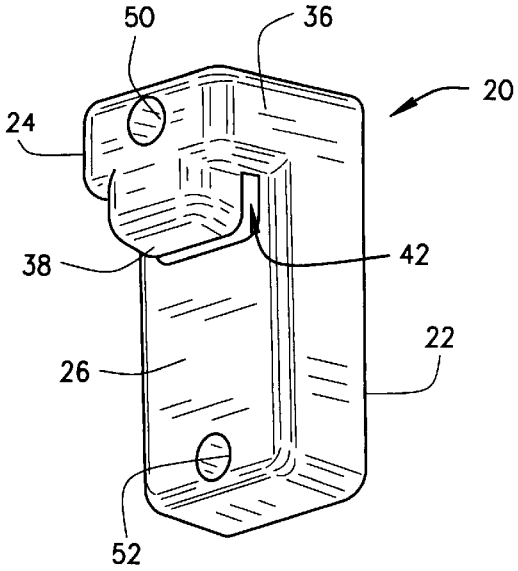
FIG. 1 is a front perspective view of a shelf anchor of the present invention.

Reference characters in these Figures correspond to reference characters in the following detailed description of the preferred embodiments.

DETAILED DESCRIPTION OF THE PREFERRED EMBODIMENTS

Figure 2:
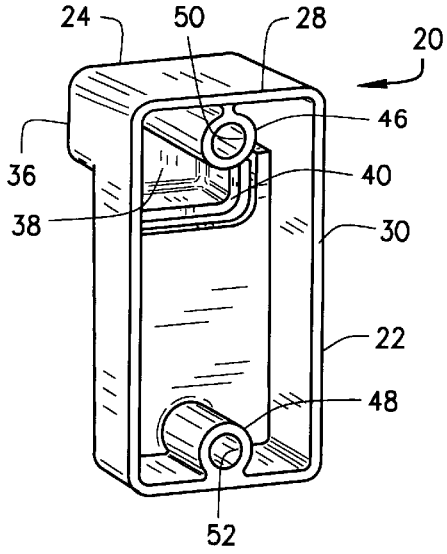
FIG. 2 is a rear perspective view of the shelf anchor of FIG. 1.
Figure 3:
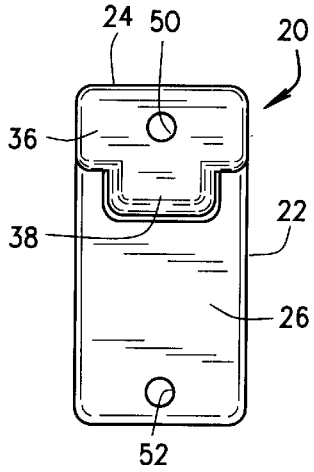
FIG. 3 is a front elevational view of the shelf anchor of FIG. 1.

A shelf anchor of the present invention is shown in detail in FIGS. 1 through 7, and is represented generally by the reference numeral 20. In general, the shelf anchor 20 comprises a base 22 and a shelf retainer 24. The base 22 has a front side 26 and an opposite rear side 28. The rear side 28 of the base 22 has a wall-engaging portion 30 adapted for flush engagement with a wall (not shown). As best shown in FIG. 2, the shelf anchor is preferably molded as a monolithic hollow piece, to reduce material costs and overall weight of the shelving unit. However, the shelf anchor could comprise multiple pieces or could be made as a solid structure without departing from the scope of the present invention. Preferably, the shelf anchor is molded of a suitable polymeric material, such as polypropylene, but other materials could be used and other manufacturing methods could be employed without departing from the scope of the present invention.

Figure 4:
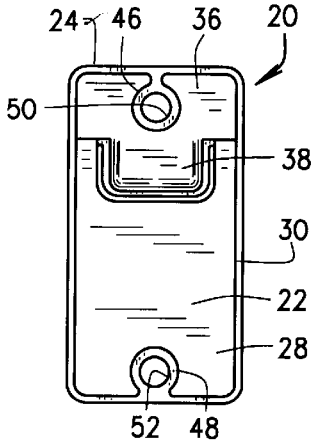
FIG. 4 is a rear elevational view of the shelf anchor of FIG. 1.

In the hollow configuration of the preferred embodiment of the shelf anchor 20 shown in FIGS. 2 and 4, the wall-engaging portion 30 of the anchor 20 is in the form of a relatively narrow, generally rectangular rim. In most cases, the shelf anchor 20 be will be mounted to a flat wall, so preferably, the entire wall-engaging portion 30 lies in a single plane.

Figure 5:
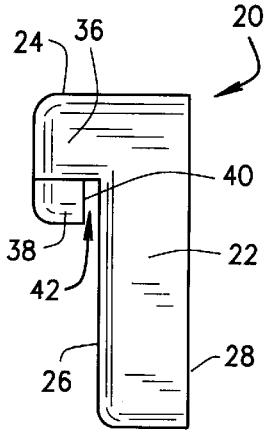
FIG. 5 is a right side elevational view of the shelf anchor of FIG. 1, the left side elevational view being a mirror image thereof.
Figure 6:
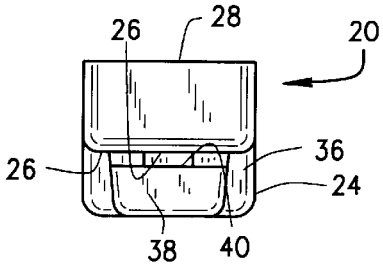
FIG. 6 is a bottom plan view of the shelf anchor of FIG. 1.
Figure 7:
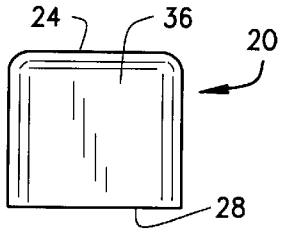
FIG. 7 is a top plan view of the shelf anchor of FIG. 1.

The shelf retainer 24 has a bridge portion 36 and a shelf-retaining portion 38. As best shown in FIGS. 1 and 5, the bridge portion 36 extends outwardly and generally horizontally from the front side 26 of the base 22. The shelf-retaining portion 38 extends generally vertically from a distal end of the bridge portion 36 so that a generally rearwardly facing surface 40 of the shelf-retaining portion 38 is spaced from the front side 26 of the base 22. As shown in the Figures, the shelf-retaining portion 38 preferably extends generally downwardly from the distal end of the bridge portion 36 to define a recess 42 between the rearwardly facing surface 40 of the shelf-retaining portion 38 and the front side 26 of the base 22. The importance of the recess 40 is explained below.

Figure 9:
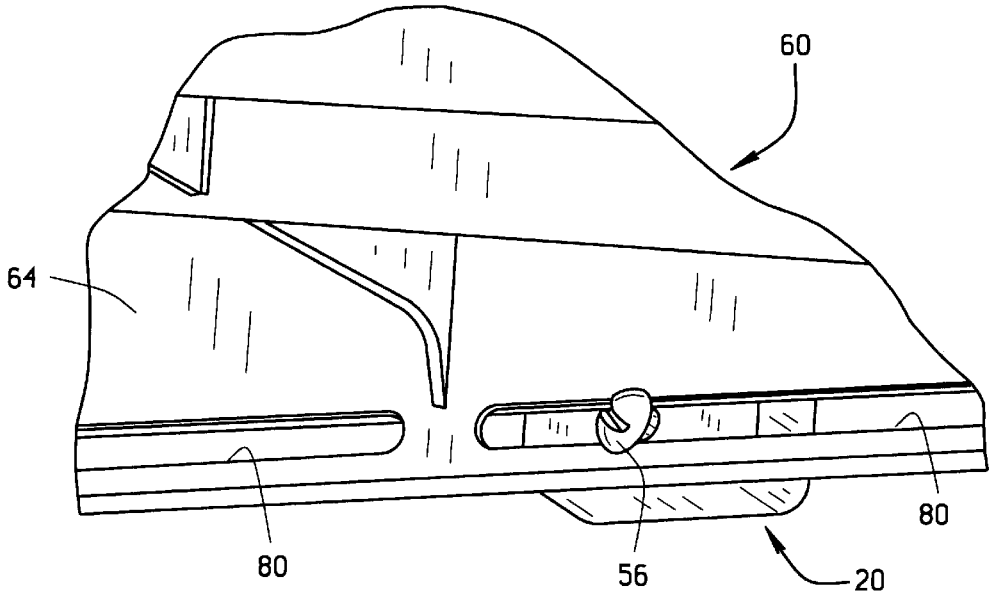
FIG. 9 is fragmented front perspective view of the shelf anchor secured to a lower part of the shelf with a mechanical fastener.
Figure 10:
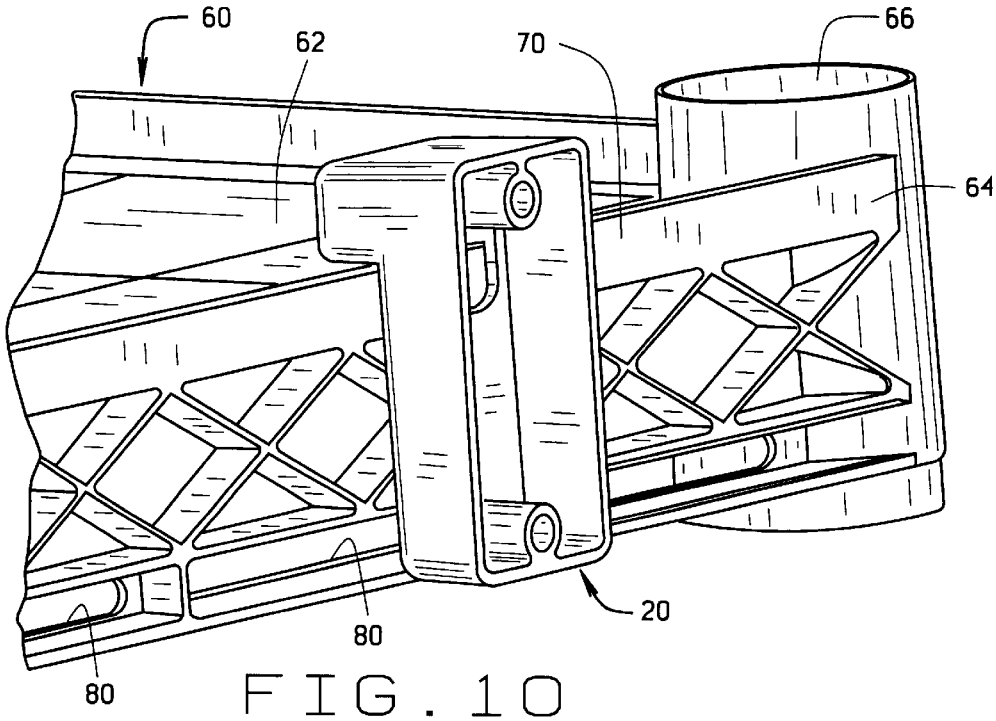
FIG. 10 is fragmented rear perspective view of the shelf anchor positioned on the peripheral rim of the shelf.

As shown in FIGS. 2, 4 and 10, the hollow shelf anchor of the preferred embodiment preferably includes a pair of bosses 46 and 48, which define holes 50 and 52 adapted to receive mechanical fasteners 56 (see FIGS. 8, 9 and 11) for securing the anchor 20 to a wall (not shown).

A shelf used with the present invention is shown in FIGS. 8 through 11, and is represented generally by the reference numeral 60. In general, the shelf 60 comprises a generally horizontal load supporting surface 62 and a vertical peripheral wall 64. Post-receiving cylinders 66 are provided at corners of the shelf 60 for receiving shelf-supporting posts (not shown). Preferably, an upper portion of the vertical peripheral wall 64 defines a generally vertical peripheral rim 70 of the shelf 60, which extends upwardly from the load supporting surface 62. Preferably, the shelf 60 is also molded of a polymeric material, such as polypropylene, but other materials could be used and other manufacturing methods could be employed without departing from the scope of the present invention.

Figure 8:
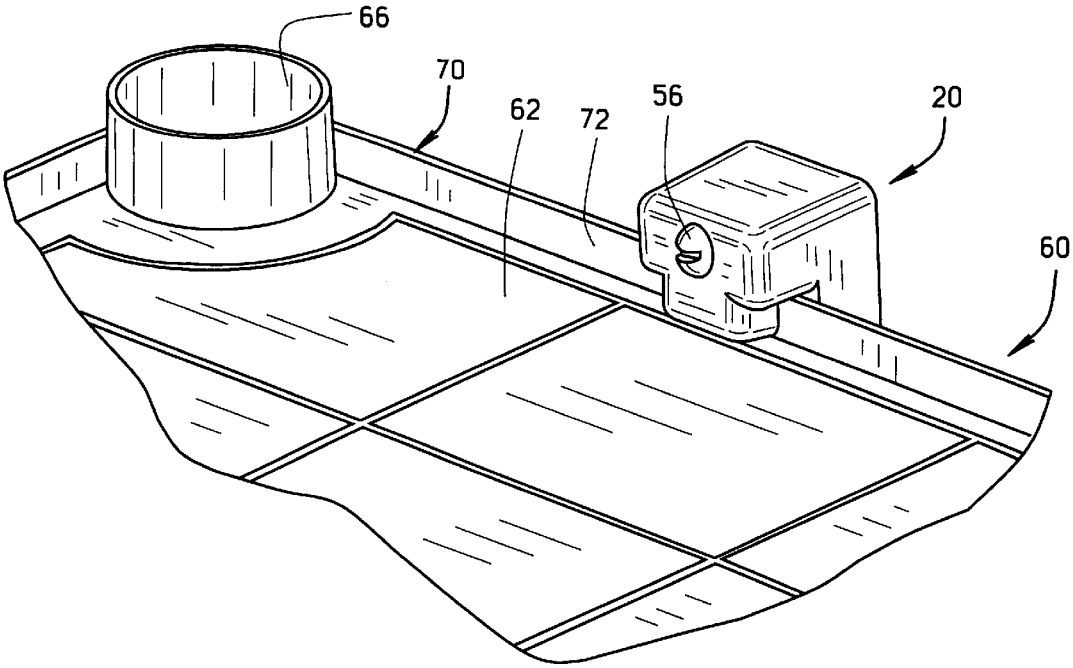
FIG. 8 is fragmented front perspective view of the shelf anchor of the present invention positioned on the peripheral rim of a shelf.
Figure 11:
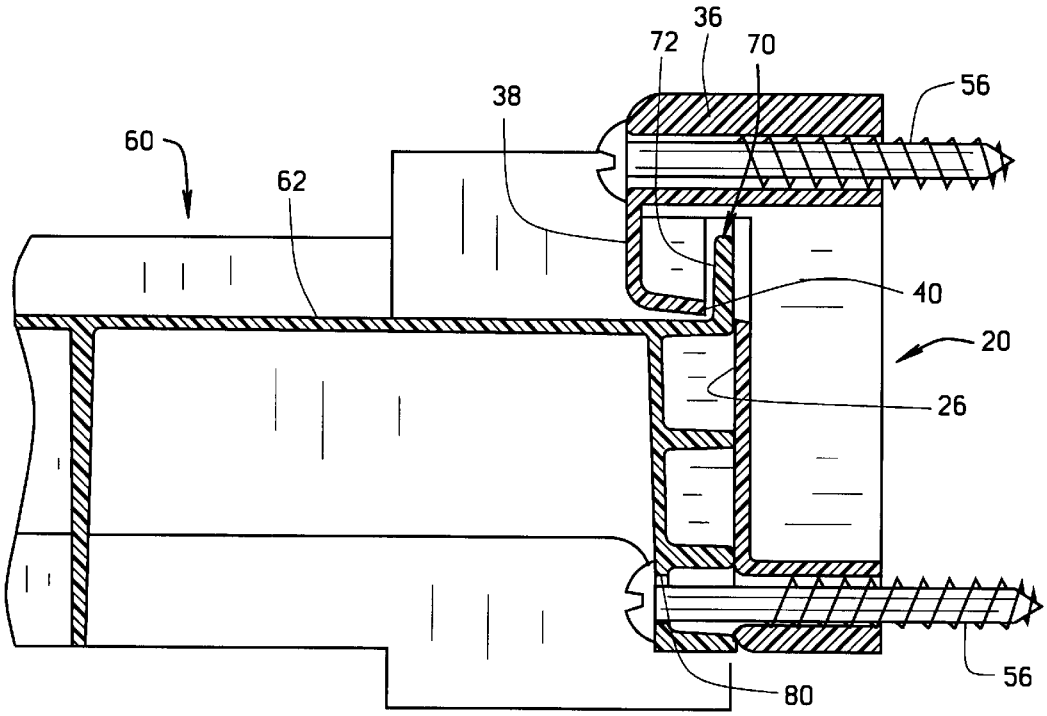
FIG. 11 is a cross-sectional side view of the shelf anchor positioned on the peripheral rim of the shelf.

As shown in FIGS. 8, 10 and 11, the rim-receiving recess 42 is sized to receive at least an upper portion of the vertical peripheral rim 70 of the shelf 60 therein. The vertical peripheral rim 70 of the shelf 60 includes a generally forwardly facing surface 72, which is adapted for engagement with the rearwardly facing surface 40 of the shelf-retaining portion 38 of the shelf anchor 20, when the shelf anchor 20 is connected to the shelf 60 as shown in FIGS. 8, 10 and 11. Thus, when the shelf anchor 20 is secured to a wall (not shown) and the peripheral rim 70 of the shelf 60 is received within the recess 42, the forwardly facing surface 72 of the rim 70 engages against the rearwardly facing surface 40 of the shelf-retaining portion 38 of the shelf anchor 20 to prevent the shelf 60 from moving outwardly away from the wall.

To this point, the preferred embodiment of the shelf anchor 20 has been described as having a shelf retaining portion 38 that extends generally downwardly to define a downwardly facing recess 42 adapted to receive a portion of the peripheral rim 70 upwardly therein. However, alternatively, the anchor could be constructed with a shelf retaining portion that extends generally upwardly to define an upwardly facing recess for receiving a peripheral wall or rim downwardly therein.

Preferably, the recess 42 comprises a channel that extends generally transversely of the front side 26 of the base 22 and generally parallel to the wall when the shelf anchor 20 is mounted to the wall to permit transverse sliding movement of the shelf anchor 20 relative to the peripheral rim 70 of the shelf 60 when the rim 70 is received within the recess 42. Thus, the shelf anchor 20 is slidable transversely along the length of rim 70, with the rearwardly facing surface 40 of the shelf retaining portion 38 in sliding engagement with the forwardly facing surface 72 of the rim 70. This permits precise lateral positioning of the shelf anchor 20 relative to the shelf 60 and relative to the wall after the anchor 20 has been connected the shelf 60. This is beneficial because, once the shelving unit has been positioned against a wall, the anchors 20 can be moved laterally along the rim 70 of the shelf 60, e.g., for alignment with wall studs, without the need to move the entire shelving unit.

As shown in FIGS. 9 and 11, the vertical peripheral wall 64 of the shelf 60 preferably includes a transverse slot 80 or other aperture adapted for receiving one of the mechanical fasteners 56 therethrough. By fastening the shelf anchor 20 to the shelf 60 with a mechanical fastener 56 passing through the slot 80, the position of the shelf anchor 20 can be fixed relative to the rim 70, after the shelf anchor has been moved to a desired location on the rim 70.

The present invention also includes a novel method of securing a shelving unit of the type described above to a wall, where the shelving unit includes at least one shelf having a peripheral rim. In general, the method comprises the steps of: providing a shelf anchor having a rim-receiving recess adapted to receive at least a portion of the peripheral rim of the shelf; positioning the shelf anchor on the peripheral rim of the shelf so that at least a portion of the peripheral rim is received within the rim-receiving recess; and securing the shelf anchor to the wall. Preferably, the step of securing the shelf anchor to the wall is performed after the step of positioning the shelf anchor on the peripheral rim of the shelf. Also, preferably, the step of securing the shelf anchor to the wall includes sliding the shelf anchor transversely along the peripheral rim of the shelf to a selected location. Again, this is beneficial because, once the shelving unit has been positioned against a wall, the anchors 20 can be moved laterally along the rim 70 of the shelf 60, e.g., for alignment with wall studs, without the need to move the entire shelving unit.

A second embodiment of a shelf anchor of the present invention is shown in FIGS. 12 through 18, and is represented generally by the reference numeral 120. In general, the shelf anchor 120 comprises a base 122 and a shelf retainer 124. The base 122 has a front side 126 and an opposite rear side 128. The rear side 128 of the base 122 has a wall-engaging portion 130 adapted for flush engagement with a wall (not shown). Like the embodiment of FIGS. 1–11, the shelf anchor 120 shown in FIGS. 12–18 may be molded as a monolithic hollow piece, to reduce material costs and overall weight of the shelving unit. However, like the embodiment of FIGS. 1–11, the shelf anchor 120 of FIGS. 12–18 may instead comprise multiple pieces or could be made as a solid structure without departing from the scope of the present invention. Like the embodiment of FIGS. 1–11, the shelf anchor 120 is preferably molded of a suitable polymeric material, such as polypropylene, but other materials could be used and other manufacturing methods could be employed without departing from the scope of the present invention.

Figure 13:
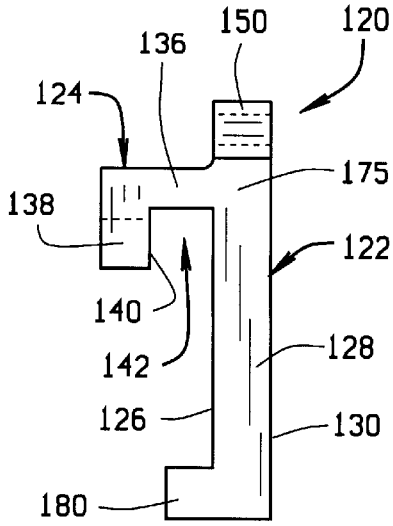
FIG. 13 is a right side elevational view of the shelf anchor of FIG. 12, the left side elevational view being a mirror image thereof.
Figure 18:
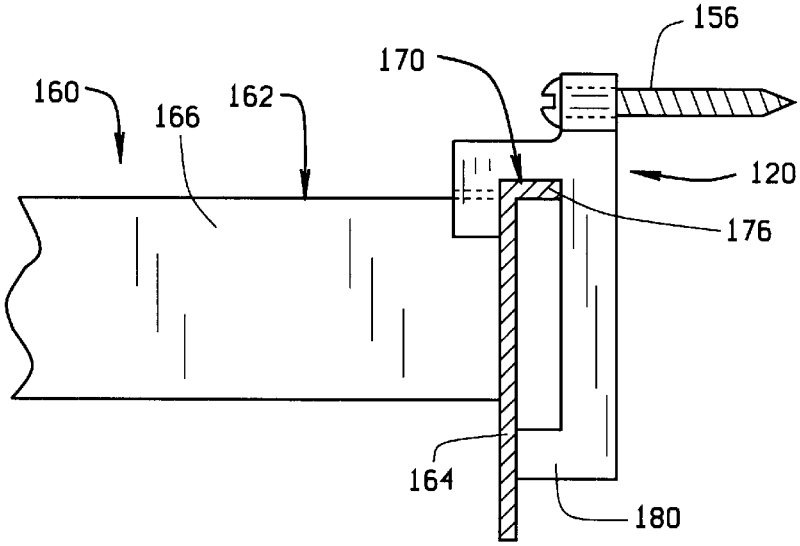
FIG. 18 is a partial cross-sectional side view of the shelf anchor of FIG. 12 positioned on the peripheral rim of the shelf.

Because the shelf anchor 120 will be mounted to a flat wall in most cases, at least a portion of the wall-engaging portion 130 should be generally planar. As best shown in FIGS. 13 and 18, preferably, the entire wall-engaging portion 130 lies in a single plane.

Figure 12:
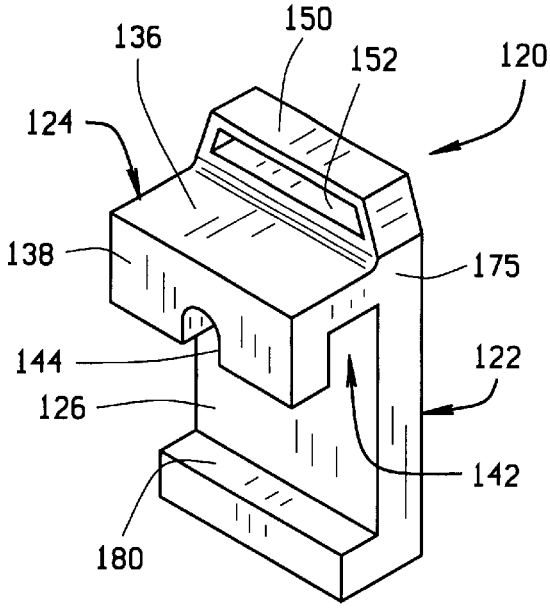
FIG. 12 is a front perspective view of a second embodiment of a shelf anchor of the present invention.

The shelf retainer 124 has a bridge portion 136 and a shelf-retaining portion 138. As best shown in FIGS. 12 and 13, the bridge portion 136 extends outwardly and generally horizontally from the front side 126 of the base 122. Preferably, the shelf-retaining portion 138 extends generally vertically downwardly from a distal end of the bridge portion 136 so that a generally rearwardly facing surface 140 of the shelf-retaining portion 138 is spaced from the front side 126 of the base 122. As best shown in FIG. 13, the rearwardly facing surface 140 and the front side 126 of the base 122 are spaced from one another to define a rim-receiving recess 142 therebetween, similar to the rim-receiving recess of the shelf anchor 20 of FIGS. 1–11.

Figure 14:
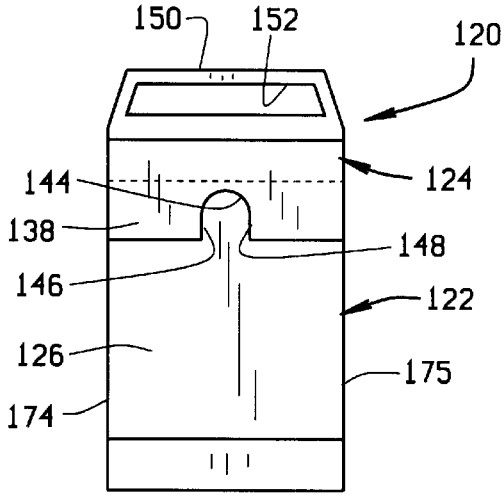
FIG. 14 is a front elevational view of the shelf anchor of FIG. 12.
Figure 15:
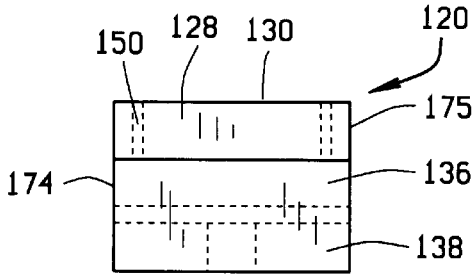
FIG. 15 is a top plan view of the shelf anchor of FIG. 12.
Figure 16:
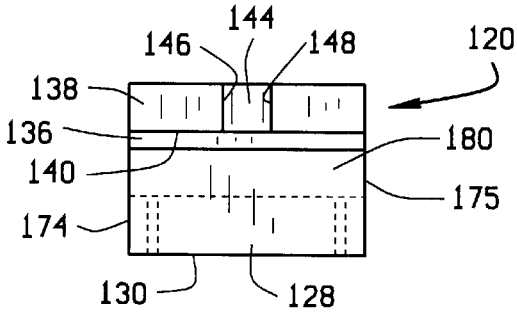
FIG. 16 is a bottom plan view of the shelf anchor of FIG. 12.

The shelf-retaining portion 138 also includes a lateral positioner. As best shown in FIGS. 12 and 14, the lateral positioner preferably comprises a positioning recess 144 extending generally vertically in a lower end of the shelf-retaining portion 138 and being open at the bottom. The positioning recess 144 includes opposed lateral engagement surfaces 146 and 148. The functions of the lateral engagement surfaces 146 and 148 are discussed below.

Figure 17:
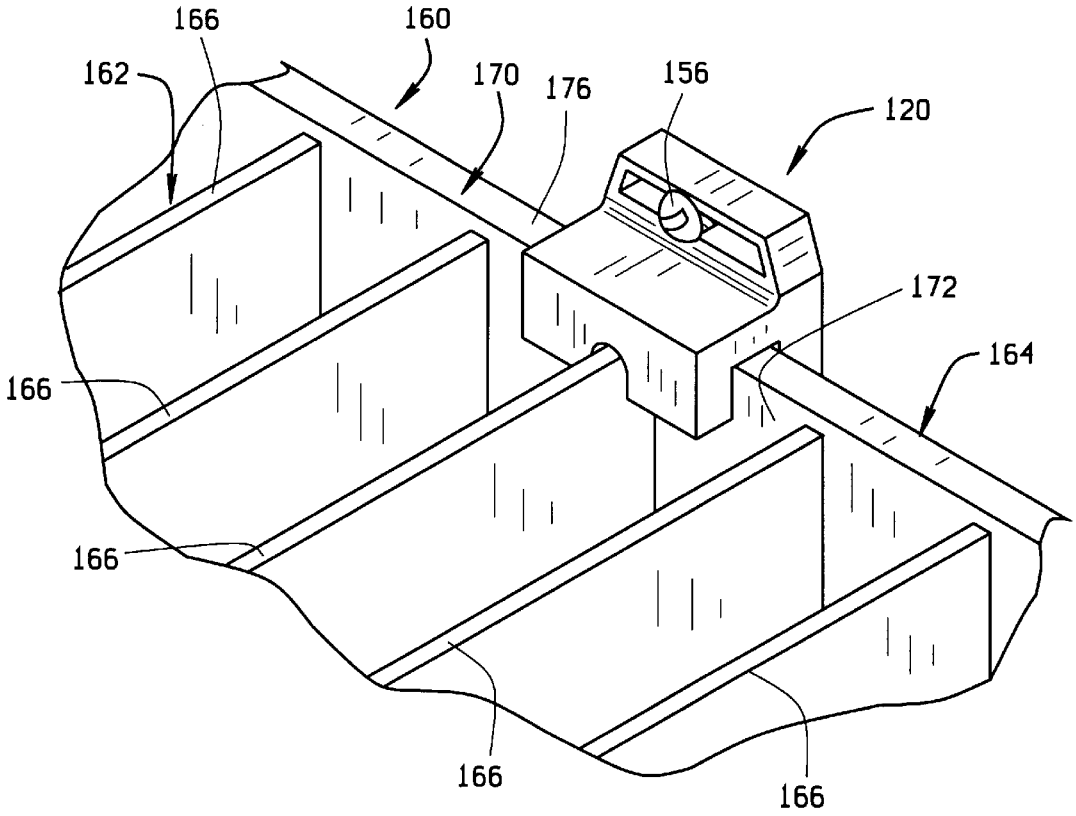
FIG. 17 is fragmented front perspective view of the shelf anchor of the present invention positioned on the peripheral rim of a shelf.

As shown in FIGS. 12, 14 and 17, the shelf anchor 120 preferably includes a boss 150, which defines an aperture 152 adapted to receive one or more mechanical fasteners 156 (see FIGS. 17 and 18) for securing the shelf anchor 120 to a wall (not shown).

The shelf anchor 120 is preferably used with a shelf 160 as shown in FIGS. 17 and 18. The shelf 160 is similar in some respects to the shelf shown in FIGS. 8 through 11 and described above. In general, the shelf 160 comprises a generally horizontal load supporting portion 162 and a vertical peripheral wall 164. Preferably, an upper portion of the vertical peripheral wall 164 defines a generally vertical peripheral rim 170 of the shelf 160. As best shown in FIG. 17, the load supporting portion 162 of the shelf is preferably comprised of a plurality of internal lateral support members (or ribs) 166 extending generally parallel to one another and generally perpendicularly to the vertical peripheral wall 164. Upper edges of the internal lateral support members 166 define a generally planar load supporting surface. Preferably, the peripheral rim 170 of the shelf 160 extends upwardly slightly higher than the load supporting surface.

Like the shelf 60 of FIGS. 8–11, the shelf 160 shown in FIGS. 17 and 18 is preferably molded entirely of a polymeric material, such as polypropylene, but other materials could be used and other manufacturing methods could be employed without departing from the scope of the present invention. Also, preferably, the internal lateral support members 166 are preferably integral with the vertical peripheral wall 164. More preferably, the lateral support members 166 and peripheral wall 164 are of a monolithic construction.

As shown in FIGS. 17 and 18, the rim-receiving recess 142 is sized to receive at least an upper portion of the vertical peripheral rim 170 of the shelf 160 therein. The vertical peripheral rim 70 of the shelf 160 includes a generally forwardly facing surface 172, which is adapted for engagement with the rearwardly facing surface 140 of the shelf-retaining portion 138 of the shelf anchor 120, when the shelf anchor 120 is connected to the shelf 160 as shown in FIGS. 17 and 18. Thus, when the shelf anchor 120 is secured to a wall (not shown) and the peripheral rim 170 of the shelf 160 is received within the recess 142, the forwardly facing surface 172 of the rim 170 engages against the rearwardly facing surface 140 of the shelf-retaining portion 138 of the shelf anchor 120 to prevent the shelf 160 from moving outwardly away from the wall.

As best shown in FIG. 17, the positioning recess 144 is sized to receive at least an upper portion of one of the internal lateral support members 166 of the shelf therein. The opposed lateral engagement surfaces 146 and 148 of the positioning recess 144 are adapted for engagement with side surfaces of the lateral support member 166 received in the positioning recess 144, when the shelf anchor 120 is in engagement with the shelf 160 as shown in FIGS. 17 and 18. Thus, when the shelf anchor 120 is secured to a wall (not shown) and the upper portion of the lateral support member 166 is received in the positioning recess 144, the opposed lateral engagement surfaces 146 and 148 of the positioning recess 144 engage against the side surfaces of the lateral support member 166 in a manner to prevent the shelf 160 from moving sideways (parallel) relative to the wall. As shown in FIG. 17, when the upper portion of the lateral support member 166 is received in the positioning recess 144, the positioning recess 144 essentially "straddles" the support member 166.

Preferably, the positioning recess 144 is sized to receive the upper portion of any of the internal lateral support members 166. Thus, the shelf anchor 120 can be placed at any selected location along the peripheral rim 170 of the shelf 160 where an internal lateral support member 166 is located. Also, the spacing between each pair of internal lateral support members 166 is preferably just greater than the overall width of the shelf anchor 120, so that the shelf anchor 120 can be placed at a selected location along the peripheral rim 170 of the shelf 160 between two lateral support member 166. When the shelf anchor 120 is placed on the rim 170 at a location between two lateral support member 166, the positioning recess 144 is not used to limit lateral movement of the shelf 160 and shelf anchor 120 relative to one another. However, when the shelf anchor 120 placed on the rim 170 at a location between two lateral support member 166, side surfaces 174 and 175 of the shelf anchor engage against the side surfaces of the lateral support members 166 in a manner to prevent the shelf 160 from moving sideways relative to the wall. This allows relatively precise lateral positioning of the shelf anchor 120 relative to the shelf 160 and relative to the wall, once a general location for the shelving unit has been determined. After a general location for the shelving unit has been determined and the shelving unit has been positioned against the wall, the anchors 120 can be positioned at desired locations on the rim 170 of the shelf 60, e.g., for alignment with wall studs, etc., without the need to move the entire shelving unit.

In the shelf 160 illustrated in FIGS. 17 and 18, the peripheral rim 170 includes a generally horizontal flange 176 that extends outwardly away from the load supporting portion 162 of the shelf. The flange 176 provides a wide, stable upper surface on which the shelf anchor 120 can rest when the peripheral rim 170 of the shelf 160 is received within the rim-receiving recess 142. When used with a shelf having such a flange, the shelf anchor 120 preferably includes a spacer 180 extending from the front side 126 of the base 122. Preferably, the spacer 180 extends from the base 122 a distance approximately equal to the distance that the flange 176 extends from the peripheral wall 164. The spacer 180 is adapted for engagement with an outer surface of the vertical peripheral wall 164 in a manner so that the shelf anchor 120 and the peripheral wall 164 remain in a substantially vertical parallel relationship. When used with a shelf having a peripheral wall without an outturned flange, the spacer 180 is not necessary to maintain the vertical parallel relationship of the shelf anchor 120 and peripheral wall 164.

The present invention also includes a novel method of securing a shelving unit of the type described above to a wall using the shelf anchor 120 shown in FIGS. 12–18. In general, the method comprises the steps of: positioning the shelf anchor 120 on the shelf 160 so that a portion of the peripheral rim 170 of the shelf 160 is received within the rim-receiving recess 142; positioning the shelf anchor 120 on the shelf so that a portion of one of the internal lateral support members 166 is received within the positioning recess 144; and securing the shelf anchor 120 to the wall.

Preferably, the steps of positioning the shelf anchor 120 on the shelf 160 so that a portion of the peripheral rim 170 is received within the rim-receiving recess 142 and positioning the shelf anchor 120 on the shelf 160 so that a portion of one of the lateral support members 166 is received within the positioning recess 144 are performed generally simultaneously. Also, preferably, step of securing the shelf anchor 120 to the wall is performed after the steps of positioning the shelf anchor 120 on the shelf 160 so that a portion of the peripheral rim 170 is received within the rim-receiving recess 142 and positioning the shelf anchor 120 on the shelf 160 so that a portion of one of the lateral support members 166 is received within the positioning recess 144. The preferred method also includes the step of selecting one of the plurality of internal lateral support members 166 to be received within the positioning recess 144. Preferably, the steps of positioning the shelf anchor 120 on the shelf 160 so that a portion of the peripheral rim 170 is received within the rim-receiving recess 142 and positioning the shelf anchor 120 on the shelf 160 so that a portion of one of the lateral support members 166 is received within the positioning recess 144 are both performed after the step of selecting one of the plurality of lateral support members 166 to be received within the positioning recess 144.

While the present invention has been described by reference to specific embodiments and specific uses, it should be understood that other configurations and arrangements could be constructed, and different uses could be made, without departing from the scope of the invention as set forth in the following claims.

What is claimed is:

1. A shelving unit comprising:

a shelf having a peripheral rim that extends along at least a portion of the length of the shelf, the shelf having at least one internal lateral support member extending generally perpendicularly to the rim; and a shelf anchor for securing the shelf to an adjacent wall, the shelf anchor including:

a base adapted to be mounted to the wall; and a shelf-retainer extending from the base, a retaining portion of the shelf-retainer being spaced from a front side of the base to define a rim-receiving recess between the base and the retaining portion of the shelf-retainer, the shelf anchor being positioned relative to the shelf so that at least a portion of the peripheral rim is received within the rim-receiving recess in a manner to prevent the shelf from moving outwardly from the wall when the shelf anchor is mounted to the wall, the shelf-retainer including a lateral positioner, the shelf anchor being positioned relative to the shelf so that at least a portion of the lateral support member engages with the positioner in a manner to prevent sideways movement of the shelf relative to the wall when the shelf anchor is mounted to the wall.

2. The shelving unit of claim 1 wherein the shelf-retainer comprises a bridge portion extending outwardly from the front side of the base, and the retaining portion of the shelf-retainer extends generally vertically from a distal end of the bridge portion.

3. The shelving unit of claim 1 wherein the lateral positioner includes a lateral engagement surface that engages an opposed lateral surface of the internal lateral support member in a manner to prevent the shelf from moving sideways relative to the wall when the shelf anchor is mounted to the wall.

4. The shelving unit of claim 3 wherein the lateral positioner comprises a positioning recess, the lateral engagement surface defining a portion of the positioning recess, the shelf anchor being positioned relative to the shelf with at least a portion of the lateral support member being received within the positioning recess in a manner so that the lateral engagement surface engages with the lateral support member to prevent the shelf from moving sideways relative to the wall when the shelf anchor is mounted to the wall.

5. The shelving unit of claim 4 wherein the positioning recess straddles the lateral support member in a manner to prevent the shelf from moving sideways relative to the wall when the shelf anchor is mounted to the wall.

6. The shelving unit of claim 1 wherein the base has at least one aperture extending therethrough, the aperture being adapted for receiving a mechanical fastener in a manner for mounting the base to the wall.

7. The shelving unit of claim 1 wherein the base and the shelf-retainer are molded of a polymeric material.

8. The shelving unit of claim 7 wherein the base and the shelf-retainer are of a single piece of polymeric material.

9. A shelving unit comprising:

a shelf having a generally vertical peripheral rim that extends along at least a portion of the length of the shelf, the shelf having at least one internal lateral support member extending generally perpendicularly to the rim; and a shelf anchor for securing the shelf to an adjacent wall, the shelf anchor including:

a base with front and rear sides, the rear side of the base having a wall-engaging portion adapted for flush engagement with the wall; and a bridge portion extending outwardly from the front side of the base;

a shelf-retaining portion extending generally vertically from a distal end of the bridge portion, the shelf-retaining portion being spaced from the front side of the base to define a rim-receiving recess between the front side of the base and the shelf-retaining portion, the shelf anchor being positioned relative to the shelf so that at least a portion of the peripheral rim is received within the rim-receiving recess in a manner to prevent the shelf from moving outwardly from the wall when the shelf anchor is mounted to the wall, the shelf-retaining portion having a positioning recess, the shelf anchor being positioned relative to the shelf so that at least a portion of the lateral support member is received within the positioning recess in a manner to prevent the shelf from moving sideways relative to the wall when the shelf anchor is mounted to the wall.

10. The shelving unit of claim 9 wherein the positioning recess straddles the lateral support member in a manner to prevent the shelf from moving sideways relative to the wall when the shelf anchor is mounted to the wall.

11. The shelving unit of claim 9 wherein the base, bridge portion and shelf-retaining portion are molded of a single piece of polymeric material.

12. A shelving unit comprising:

a shelf having a generally vertical peripheral rim that extends along at least a portion of the length of the shelf; and a shelf anchor for securing the shelf to an adjacent wall, the shelf anchor including:

a base with front and rear sides, the rear side of the base having a wall-engaging portion adapted for flush engagement with the wall; and a bridge portion extending outwardly from the front side of the base;

a shelf-retaining portion extending generally vertically from a distal end of the bridge portion, the shelf-retaining portion being spaced from the front side of the base to define a rim-receiving recess between the front side of the base and the shelf-retaining portion, the shelf anchor being positioned relative to the shelf so that at least a portion of the peripheral rim is received within the rim-receiving recess in a manner to prevent the shelf from moving outwardly from the wall when the shelf anchor is mounted to the wall; and a lateral engagement surface that engages an opposed lateral surface of the shelf in a manner to prevent the shelf from moving sideways relative to the wall when the shelf anchor is mounted to the wall.

13. The shelving unit of claim 12 wherein the shelf includes at least one internal lateral support member extending generally perpendicularly to the rim and the shelf-retaining portion includes a positioning recess, the lateral engagement surface defining a portion of the positioning recess, the shelf anchor being positioned relative to the shelf with at least a portion of the lateral support member being received within the positioning recess in a manner so that the lateral engagement surface engages with the lateral support member to prevent the shelf from moving sideways relative to the wall when the shelf anchor is mounted to the wall.

14. The shelving unit of claim 13 wherein the positioning recess straddles the lateral support member in a manner to prevent the shelf from moving sideways relative to the wall when the shelf anchor is mounted to the wall.

15. The shelving unit of claim 12 wherein the base, bridge portion and shelf-retaining portion are molded of a single piece of polymeric material.

16. A method of securing to a wall a shelving unit having at least one shelf with a peripheral rim and a plurality of internal lateral support members, the method comprising the steps of:

providing a shelf anchor having a rim-receiving recess adapted to receive a portion of the peripheral rim, and a positioning recess adapted to receive a portion of one of said internal lateral support members;

positioning the shelf anchor on the shelf so that a portion of the peripheral rim is received within the rim-receiving recess;

positioning the shelf anchor on the shelf so that a portion of one of said internal lateral support members is received within the positioning recess; and securing the shelf anchor to the wall.

17. The method of claim 16 wherein the steps of positioning the shelf anchor on the shelf so that a portion of the peripheral rim is received within the rim-receiving recess and positioning the shelf anchor on the shelf so that a portion of one of said internal lateral support members is received within the positioning recess are performed generally simultaneously.

18. The method of claim 17 wherein the step of securing the shelf anchor to the wall is performed after the steps of positioning the shelf anchor on the shelf so that a portion of the peripheral rim is received within the rim-receiving recess and positioning the shelf anchor on the shelf so that a portion of one of said internal lateral support members is received within the positioning recess.

19. The method of claim 16 further comprising the step of selecting one of said plurality of internal lateral support members to be received within the positioning recess.

20. The method of claim 19 wherein the steps of positioning the shelf anchor on the shelf so that a portion of the peripheral rim is received within the rim-receiving recess and positioning the shelf anchor on the shelf so that a portion of one of said internal lateral support members is received within the positioning recess are performed after the step of selecting one of said plurality of internal lateral support members to be received within the positioning recess.

* * * * *